United States Patent [19]

Moscovich

[11] Patent Number: 4,898,560

[45] Date of Patent: Feb. 6, 1990

[54] MIRROR PATTERN FORMING AMUSEMENT DEVICE

[76] Inventor: Ivan Moscovich, 19 Elkachi Street, Afeka, Ramat Aviv, Israel

[21] Appl. No.: 308,155

[22] Filed: Feb. 9, 1989

[51] Int. Cl.[4] ..... A63H 33/04; A63H 33/22

[52] U.S. Cl. ..... 446/85; 446/147; 446/219; 272/8 M; 350/612; 350/630; 434/76; 434/303; 40/900

[58] Field of Search ..... 446/85, 219, 147, 97, 446/99, 100; 272/8 M; 350/612, 613, 616, 622, 630; 273/156, 157 R; 40/582, 900, 219; 434/76, 303, 371

[56] References Cited

U.S. PATENT DOCUMENTS

| | | | |
|---|---|---|---|
| 234,778 | 11/1880 | Hocker | 272/8 M X |
| 569,503 | 10/1896 | Keyes | 350/613 |
| 1,110,296 | 9/1914 | Wiley | 272/8 M X |
| 2,381,801 | 8/1945 | Bloxom | 272/8 M |
| 2,697,380 | 12/1954 | Wyser | 40/900 X |
| 3,235,263 | 2/1966 | Smith | 273/156 |

FOREIGN PATENT DOCUMENTS

| | | | |
|---|---|---|---|
| 329523 | 11/1920 | Fed. Rep. of Germany | 350/630 |

*Primary Examiner*—Mickey Yu

*Attorney, Agent, or Firm*—Benjamin J. Barish

[57] ABSTRACT

An amusement device having a plurality of mirror blocks of the same size and configuration, each of the blocks having a mirror face adapted to face upwardly when the blocks are supported on a flat horizontal supporting surface, and a plurality of pattern-bearing elements each bearing a partial section of an overall pattern and selectively positionable with respect to the mirror faces of the blocks to reconstruct the overall pattern by reflections from the mirror faces of the mirror blocks.

16 Claims, 3 Drawing Sheets

FIG 1
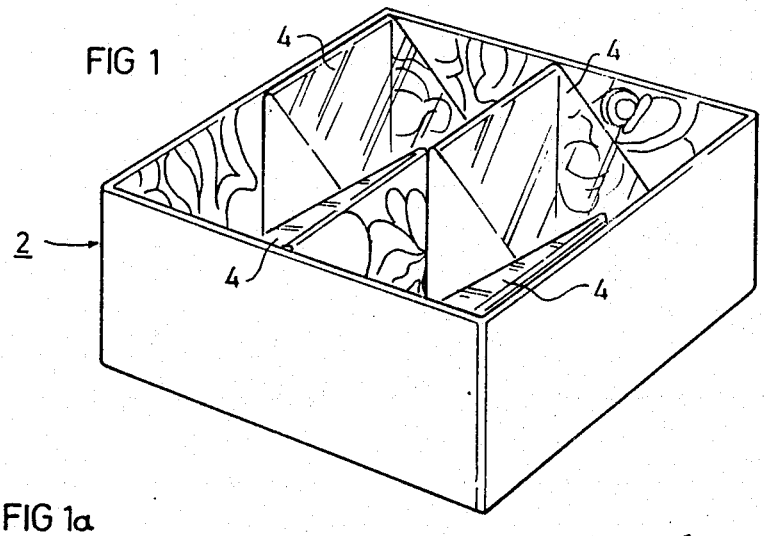
FIG 1a
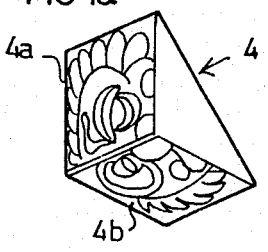
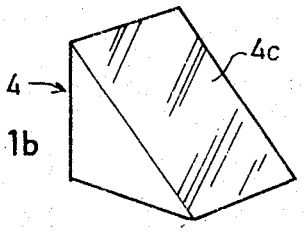
FIG 1b
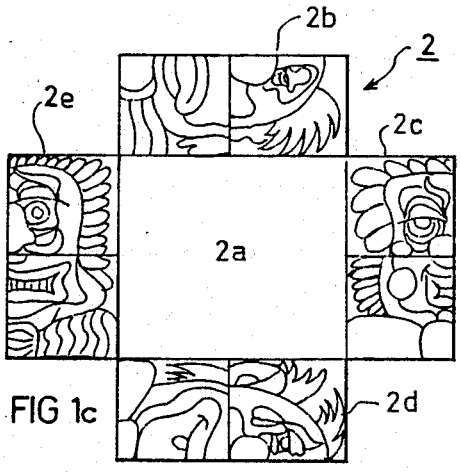
FIG 1c
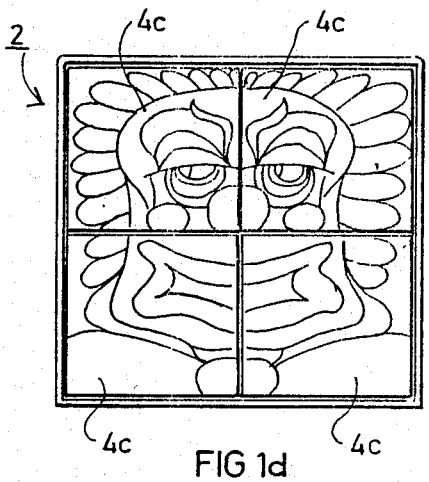
FIG 1d FIG 2
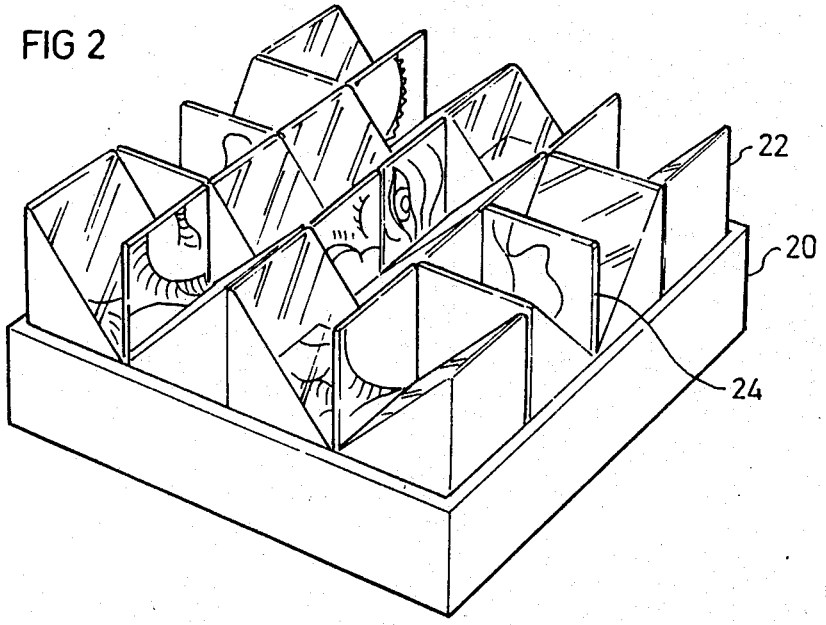
FIG 2a
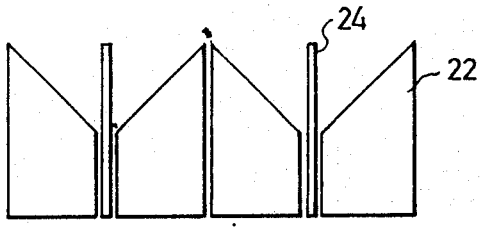
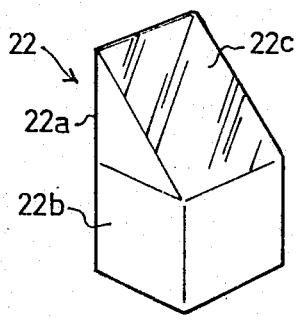
FIG 2b
FIG 2c
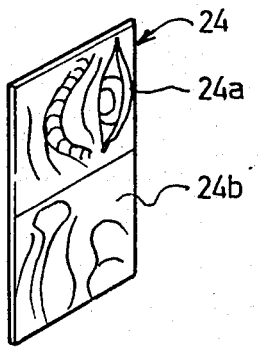

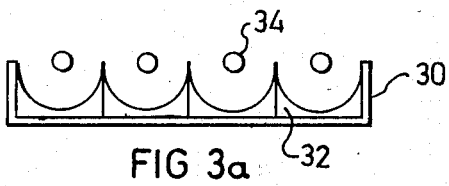
FIG 3a
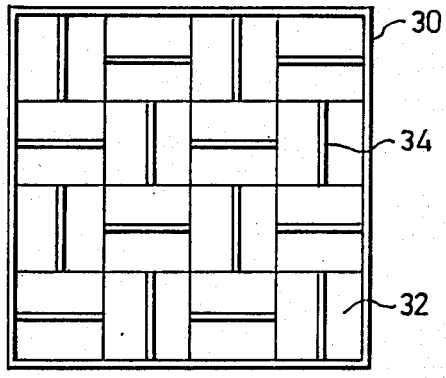
FIG 3
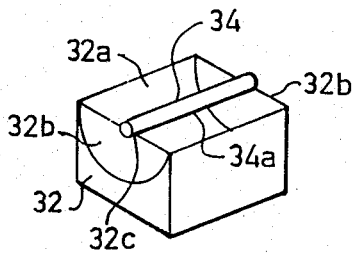
FIG 3b
FIG 4
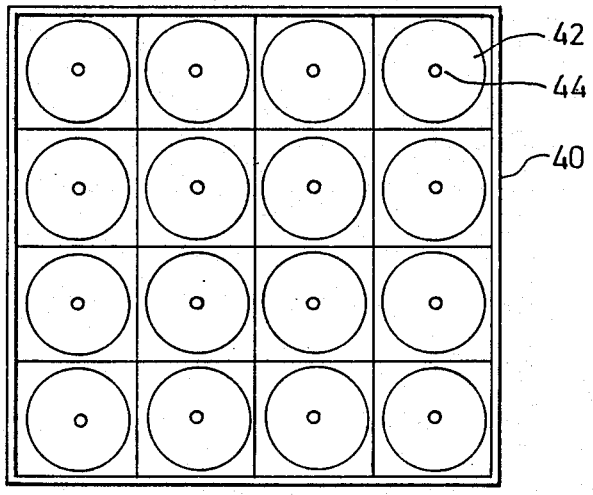
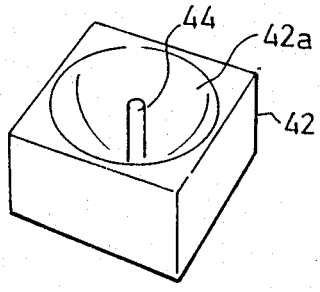
FIG 4b
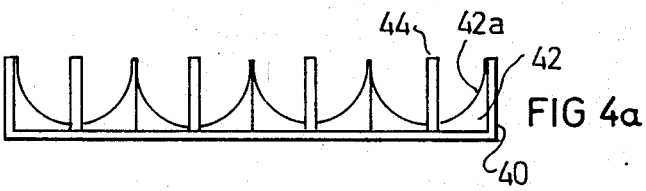
FIG 4a

MIRROR PATTERN FORMING AMUSEMENT DEVICE

BACKGROUND OF THE INVENTION

The present invention relates to amusement devices, and particularly to a puzzle-type amusement device having a plurality of members which may be assembled to produce different patterns or pictures.

Many types of puzzles are known including a plurality of members each bearing a partial section of an overall pattern or picture, which members are to be assembled in certain relative positions in order to reconstruct the overall pattern. In the known devices, the patterns are applied to blocks, discs, or other similar elements, which are assembled together.

An object of the present invention is to provide an amusement device of the foregoing type in which the pattern sections which are assembled together to produce an overall pattern are not the patterns themselves, but rather are reflected images of the patterns, thereby adding a new dimension to the fascination and challenge of manipulating the amusement device.

BRIEF SUMMARY OF THE INVENTION

According to the present invention, there is provided an amusement device comprising a plurality of mirror blocks of the same size and configuration. Each of the blocks has a flat face for permitting the block to rest on a flat horizontal surface, and a mirror face to face upwardly when the block is supported on a flat horizontal supporting surface. The device further includes a plurality of pattern-bearing elements each bearing a partial section of an overall pattern and selectively positionable with respect to the mirror faces of the blocks to reconstruct the overall pattern by reflections from the mirror faces of the mirror blocks.

Several embodiments of the invention are described below for purposes of example.

In one described embodiment, some or all of the pattern-bearing elements are carried by the mirror blocks themselves, i.e., on faces of the blocks other than the mirror faces. In this described embodiment, the blocks are of the shape of right-triangular prisms each having two perpendicular faces carrying the pattern-bearing elements, and a diagonal face constituting the mirror face. The amusement device further includes a container for the plurality of blocks, the inner side faces of the container also carrying pattern-bearing elements.

In a second described embodiment, the picture-bearing elements are carried on opposite faces of planar members. e.g., cards, insertable between pairs of the mirror blocks.

Two further embodiments are described wherein the mirror faces of the mirror blocks are curved, and the pattern-bearing elements are carried by members supported by the mirror blocks. In one of these embodiments, the curved mirror faces are substantially semi-cylindrical, and the pattern-bearing elements are cylindrical members of substantially smaller diameter than the semi-cylindrical mirror faces and are supported horizontally along the longitudinal axis of each mirror block. In the other embodiment, the curved mirror faces are substantially semi-spherical, and the pattern-bearing elements are supported vertically from the center of the respective semi-spherical mirror face.

It will thus be seen that an amusement device constructed in according with the foregoing features provides additional fascination and challenge to the player since the player is dealing not with actual images of patterns or pictures, but rather with reflected images. The sections of the patterns and pictures are not actually there where the player sees them, or where he wishes to see them, and it is not always easy to see where the parts of the pattern really are. The player must thus exercise a higher degree of skill and imagination than when playing with the conventional type blocks to assemble patterns.

Further features and advantages of the invention will be apparent from the description below.

BRIEF DESCRIPTION OF THE DRAWINGS

The invention is herein described, by way of example only, with reference to the accompanying drawings, wherein:

FIG. 1 illustrates one form of amusement device constructed in accordance with the present invention, FIGS. 1*a* and 1*b* illustrating opposite sides of one of the mirror blocks in the amusement device, FIG. 1*c* illustrating the container in flattened condition for the mirror blocks, and FIG. 1*d* illustrating one form of overall pattern which may be constructed by the player;

FIG. 2 illustrates another amusement device constructed in accordance with the present invention, FIG. 2*a* being a side view illustrating a line of the mirror blocks and pattern cards, FIGS. 2*b* and 2*c* illustrating one card and one mirror block, and FIG. 2*d* illustrating one form of overall pattern which may be constructed by the blocks and cards of FIG. 2;

FIG. 3 illustrates a third form of amusement device constructed in accordance with the present invention, FIG. 3*a* being a side elevational view of the mirror blocks and the pattern-bearing elements, FIG. 3*b* illustrating one such mirror block and picture-bearing element; and FIG. 4 illustrates a fourth form of amusement device constructed in accordance with the present invention, FIG. 4*a* being a side elevational view illustrating the mirror blocks and the picture-bearing elements, and FIG. 4*b* illustrating one mirror block and its picture-bearing element.

DESCRIPTION OF PREFERRED EMBODIMENTS

The Embodiment of FIG. 1.

The amusement device illustrated in FIG. 1 comprises a container, generally designated 2, and a plurality of mirror blocks, each generally designated 4, freely disposed within the container such that each may be removed and placed in other positions within the container. In the illustrated embodiment, container 2 is of square configuration, in which each of its four sides are equal to twice the length of each of the mirror blocks 4, such that the container accommodates four mirror blocks.

Each of the four mirror blocks 4 is of the shape of a right-triangular prism, having two planar faces 4*a*, 4*b* (FIG. 1*a*) perpendicular to each other, and a planar diagonal face 4*c* (FIG. 1*b*). The planar diagonal face 4*c* constitutes a mirror face and is formed to be light reflecting, whereas each of the perpendicular faces 4*a*, 4*b* of the block bears a partial section of an overall pattern or picture. The two perpendicular faces 4*a*, 4*b* also permit the block to rest in either of two positions on the flat horizontal bottom surface of the container with the mirror face 4c facing upwardly.

FIG. 1c illustrates the flattened condition of container 2, wherein it will be seen that it includes a central square section 2a constituting the bottom wall and four side panels 2b–2e which, when folded perpendicular to the central section 2a, form the four side walls of the container. Each of the side panels 2b–2e also bears a partial section of an overall pattern. These sections are combinable with the partial pattern sections on the perpendicular faces 4a, 4b of the mirror blocks 4, to produce one or more different overall patterns. Since each side of the container 2 is twice the length of each of the mirror blocks 4, each side panel 2b–2e of the container includes two partial sections of an overall pattern, each cooperable with one of the mirror blocks 4 when placed within the container.

Each of the mirror blocks 4 is placed within the container with its mirror face 4c facing upwardly. Accordingly, the pattern section aligned with that mirror face, whether borne by one of the side faces 2b–2e of the container, or one of the two perpendicular faces 4a, 4b of another mirror block, will be reflected upwardly towards the viewer.

In the example illustrated in FIG. 1, an overall pattern or picture is divided into four sections, and the four sections are distributed among the pattern-bearing surfaces of the side panels 2b–2e of the container and among the perpendicular faces 4a, 4b of the four mirror blocks 4. Thus, the illustrated embodiment would include eight pattern sections on the mirror blocks 4, and eight additional pattern sections on the side faces 2b–2e of the container 2, or a total of sixteen sections. Each overall pattern requires four pattern sections reflected from the mirror faces 4c of the four blocks 4.

FIG. 1d illustrates one overall pattern which may be formed by the positioning of the mirror blocks 4, but it will be appreciated that many other patterns may be produced, according to the various combinations of picture sections made by the positioning of the mirror blocks.

The Embodiment of FIG. 2

FIG. 2 illustrates another amusement device also including a container 20 and a plurality of mirror blocks 22. In this case, however, the pattern sections are not borne by the mirror blocks or by the container, as in the embodiment of FIG. 1, but rather by planar elements or cards, each generally designated 24, insertable between pairs of the mirror blocks 22.

FIG. 2b illustrates one of the mirror blocks 22. It includes an upper section 22a in the form of a right-triangular prism, and a lower section 22b in the form of a right-square prism. The right-triangular prism section 22a is formed with a planar mirror face 22c which faces upwardly at a 45° angle when the block is supported by its base section 22b within container 20 or on any other flat horizontal surface.

Container 20 is of square configuration, with each side being slightly greater than four times the length of each side of one of the mirror blocks 22. Accordingly, container 20 is adapted to receive sixteen such mirror blocks, with the mirror faces 22c of adjacent mirror blocks facing each other, as shown in FIG. 2a, and with a slight space between each such pair of mirror blocks for receiving one of the pattern-bearing cards 24.

FIG. 2c illustrates one of the pattern-bearing cards 24. Each such card is of rectangular configuration and has a width equal to that of each of the mirror blocks 22. The length of each card is equal to the combined heights of the two sections 22a and 22b of each mirror block. Each card 24 includes two partial sections of an overall pattern, as shown by sections 24a and 24b in FIG. 2c on each face of the card. Thus, four such pattern sections would be included in each card.

The amusement device illustrated in FIG. 2 is used in the following manner: Container 20 is first filled with the mirror blocks 22, there being four blocks arranged on each side. Each side includes two pairs of blocks, with each pair having their diagonal mirror faces 22c facing each other as shown in FIG. 2a.

As mentioned earlier, each side 20 of the container is sufficiently long so that one of the pattern-bearing cards 24 may be inserted between the two blocks of each pair, as also shown in FIG. 2a, so that the upper pattern section 24a (FIG. 2a) of the card is aligned with the mirror faces 22c of the respective pair of blocks. Accordingly, the two mirror faces 22c of the respective pair of blocks 22 will reflect the pattern sections 24a on the opposite faces of the respective card 24 inserted between the two blocks.

Each of the cards 24 may be freely removed and inserted, from either end, so that by selectively relocating the cards, and selectively orienting their ends and their faces with respect to the mirror faces 22c of the mirror blocks 22, various overall patterns can be constructed and projected to the viewer, who sees, not the actual pattern sections, but rather the pattern sections as reflected upwardly from the mirror faces 22c of the mirror blocks.

The Embodiment of FIG. 3

FIG. 3 illustrates a further embodiment of the invention, also including a container 30, and a plurality of mirror blocks, each generally designated 32, of square configuration and arranged in a rectangular matrix of four horizontal rows and four vertical columns. In this case, however, each mirror block 32 is formed with a mirror face which is not planar, as in the embodiments, of FIGS. 1 and 2, but rather which is curved in the form of a semi-cylinder, as shown at 32a in FIG. 3b.

Each mirror 32 is adapted to support a pattern-bearing element 34 which is also of cylindrical configuration, but of substantially smaller diameter than the semi-cylindrical mirror face 32a. Thus, each of the mirror blocks 32 includes a pair of upstanding end walls 32b formed with notches 32c aligned with each other along the longitudinal axis of the cylinder for supporting the pattern-bearing elements 34.

Each of the pattern-bearing elements 34 bears a partial section of a pattern on its lower face 34a such that, when the element is supported by notches 32c of its respective mirror block 32, the semi-cylindrical mirror face 32a of the block projects an expanded image of the pattern section upwardly to the viewer. Accordingly, by selectively positioning the pattern-bearing elements 34 on the various mirror blocks 32, different overall patterns may be formed to the viewer.

Preferably, as particularly shown in FIG. 3, the mirror blocks 32 are arranged alternately in the rows and columns so as to receive the cylindrical picture-bearing elements 34 in an alternating manner with respect to the two orthogonal axes. Whereas the lower face 34a of each pattern-bearing element 34 bears a pattern section, to be fitted into the overall pattern, it will be appreciated that the upper face of element 34 could also bear a pattern section, thereby further increasing the various permutations and combinations of pattern actions that can be combined together to produce the overall pattern viewable to the viewer.

The Embodiment of FIG. 4

FIG. 4 illustrates a still further embodiment of the invention, also including a container 40 filled with a plurality of mirror blocks 42 each cooperable with a pattern-bearing element 44, which elements are adapted to be selectively position with respect to the mirror blocks to construct an overall pattern or picture. In the embodiment of FIG. 4, however, each mirror block 42 is formed with an upwardly-facing semi-spherical mirror face 42*a*, and the picture-bearing elements 44 are also of cylindrical configuration, but are supported vertically from the center of the semi-spherical mirror face of their respective mirror blocks 42. Thus, each of the semi-spherical mirror faces 42*a* is formed with a central opening adapted to receive one of the pattern-bearing elements 44. The pattern carried by each of such elements 44 is such that its image is expanded and is reflected upwardly by its respective mirror face 42*a* so as to produce a partial section of the overall pattern.

While the invention has been described with respect to several preferred embodiments, it will be appreciated that many other variations, modifications and applications of the invention may be made.

What is claimed is:

1. An amusement device comprising:

a plurality of mirror blocks of the same size and configuration, each of the blocks having a flat face for permitting the block to rest on a flat horizontal surface, and a mirror face a to face upwardly when the block is supported on said flat horizontal supporting surface;

and a plurality of pattern-bearing elements each bearing a partial section of an overall pattern and selectively positionable with respect to the mirror faces of said blocks to reconstruct the overall pattern by reflections from the mirror faces of the mirror blocks.

2. The amusement device according to claim 1, wherein said mirror faces are planar faces and face upwardly at a 45° angle when the blocks are supported on the flat horizontal surface.

3. The amusement device according to either claim 1, wherein said pattern-bearing elements are carried on faces of said mirror blocks other than said mirror faces.

4. The amusement device according to claim 3, wherein said mirror blocks are of the shape of right-triangular prisms each having two perpendicular faces carrying pattern-bearing elements and a diagonal face constituting said mirror face.

5. The amusement device according to claim 4, further including a container for the plurality of blocks, the inner side faces of the container also carrying pattern-bearing elements.

6. The amusement device according to claim 1, wherein said pattern-bearing elements are carried on opposite faces of planar members insertable between pairs of said mirror blocks.

7. The amusement device according to claim 6, wherein said mirror faces are planar faces and face upwardly at a 45° angle when the blocks are supported on the flat horizontal surface.

8. The amusement device according to claim 7, wherein each of said planar members carries four of said pattern-bearing elements, there being two of said pattern-bearing elements on each of its two opposite faces.

9. The amusement device according to claim 6, wherein each of said mirror blocks includes a base section in the configuration of a right-square prism, and a mirror section in the configuration of a right-triangular prism, with the diagonal face of the latter prism constituting said mirror face.

10. The amusement device according to claim 1, wherein the upwardly facing mirror faces of said mirror blocks are curved, and said pattern-bearing elements are carried pattern-bearing by members supported by said mirror blocks.

11. The amusement device according to claim 10, wherein said curved mirror faces are each substantially semi-cylindrical, and said pattern-bearing members are cylindrical members of substantially smaller diameter than the semi-cylindrical mirror faces of the mirror blocks and are supported horizontally over their respective mirror blocks along the longitudinal axis thereof.

12. The amusement device according to claim 11, wherein the cylindrical pattern-bearing members are supported by end walls on the opposite ends of said semi-cylindrical mirror face of each of the mirror blocks.

13. The amusement device according to claim 12, wherein said end walls are centrally notched for receiving said cylindrical pattern-bearing members.

14. The amusement device according to claim 11, wherein each of said cylindrical pattern-bearing members includes two patterns extending along opposite sides of the pattern-bearing member.

15. The amusement device according to claim 1, wherein the upwardly facing mirror faces are each substantially semi-spherical, and said pattern-bearing elements are supported vertically from the center of the respective semi-spherical mirror face.

16. The amusement device according to claim 15, wherein each of said semi-spherical mirror faces is formed with a central opening for supporting one of the pattern-bearing elements vertically.

* * * * *